United States Patent [19]

Lohninger

[11] 3,937,145

[45] Feb. 10, 1976

[54] HELICAL BAFFLE FOR THE DENSITY INTEGRATING FUZE HEAD

[75] Inventor: Wilhelm J. Lohninger, Rockaway, N.J.

[73] Assignee: The United States of America as represented by the Secretary of the Army, Washington, D.C.

[22] Filed: May 10, 1974

[21] Appl. No.: 468,723

[52] U.S. Cl. ..... 102/73 R; 102/81

[51] Int. Cl.[2] ..... F42C 1/00

[58] Field of Search ..... 102/70, 73, 76, 81, 81.2

[56] References Cited

UNITED STATES PATENTS

| | | | |
|---|---|---|---|
| 1,666,792 | 4/1928 | Remondy | 102/73 R |
| 2,779,285 | 1/1957 | Kuller | 102/73 R |
| 3,135,206 | 6/1964 | Elm | 102/73 R |
| 3,726,228 | 4/1973 | Lohninger et al. | 102/73 R |
| 3,807,307 | 4/1974 | Putscher | 102/73 R |
| 3,854,402 | 12/1974 | Kosonacky | 102/73 R |

*Primary Examiner*—Stephen C. Bentley
*Assistant Examiner*—Harold Tudor
*Attorney, Agent, or Firm*—Nathan Edelberg; Robert P. Gibson; Costa Perchem

[57] ABSTRACT

In the present invention a helical baffle is provided in a fuze head to prevent a direct impact on the detonator by providing an effective cover to all elements of the detonator. This is done by providing a helical structure for protection against, solid objects, the build-up of a large volume of rain and inhibit direct impact of such material upon the detonator.

1 Claim, 4 Drawing Figures

HELICAL BAFFLE FOR THE DENSITY INTEGRATING FUZE HEAD

GOVERNMENTAL INTEREST

The invention described herein may be manufactured, used and licensed by or for the Government for governmental purposes without the payment to me of any royalty thereon.

BACKGROUND OF THE INVENTION

This invention relates to fuzes and more particularly to a fuze for an explosive apparatus that is protected against premature detonation until it reaches the intended target. A prior structure related to subject invention is described in U.S. Pat. No. 3,726,228 filed Nov. 23, 1970 and issued on Apr. 10, 1973. More specifically the Density Integrating Fuze Head described in the reference patent provided cross-bars as a protective shield to prevent premature detonation. The cross-bars were used in the fuze head as a mechanical barrier which allowed retaining the sensitivity of the detonator yet exposing the shell to various interferences before its impact with the ground. This barrier device including the relief vents has been particularly well adapted in actual use associated with military fuzes in a tropical environment.

The prior structure, however, as disclosed in the referenced patent has several drawbacks in that under certain situations various objects are able to by-pass the cross-bars and impact directly on the detonator causing the shell to prematurely explode. For example, the cross-bars cover less than 20 percent of the surface of the detonator permitting the detonator to be exposed to direct impact. Furthermore, the cross-bars are capable of accumulating water from raindrops and when the volume could not be retained, the water would move directly upon the detonator with a greater mass causing the shell to explode. In addition under the action of an impact force produced by leaves, limbs and thin branches a cross-bar is subject to bending and probably dislocation. In fact the resistance or stiffness of a cross-bar to bending is substantially less than the resistance of a solid protective piece resting at the base since it is susceptible only to compression. When under the action of an impact force a cross-bar is bent towards the closing disc to a deflection equal to its diameter, then the cross-bar slips out from the cross-bar holder wall and offers no more resistance against subsequent impact. These problems have prompted a re-evaluation for additional protection of the detonator requiring a closer and more critical analysis of the geometrical and kinematical parameters.

The muzzle velocity of a round is 2700 feet per second and the spin rate is 285 revolutions per second; therefore a raindrop needs only 23 microseconds to travel the length of the cylindrical frame. During the time it takes the raindrop to travel the length of the cavity, the shell rotates an angle of 2.3°. This ratio of travel distance to rotation angle means that there is a definite possibility for a raindrop, snowflake or other matter, to travel the cavity length straight and undisturbed and eventually impact directly on the detonator without striking the cross-bars.

As can readily be seen, it is highly desirable that the detonator be effectively covered by a barrier. This would prevent small objects from moving directly and in an axial path gaining acceleration and impinging on the detonator triggering the fuze. An effective barrier would prevent axially moving light objects such as raindrops or leaf fragments from directly impacting the detonator while retaining the sensitivity of the detonator. A barrier would reduce considerably the probability of premature detonation since incoming material would be decelerated from the recess entrance to the bottom end of the cavity.

In the prior structure, the barrier means consisted of three cross-bars placed in a cavity in front of the detonator at equal parallel intervals perpendicular to the axis of the shell. This resulted in a partial covering of the detonator particularly at its inner perimeter, leaving the outer perimeter exposed.

BRIEF SUMMARY OF THE INVENTION

The present invention utilizes a similar theory to accomplish the protection of the detonator by placing a barrier in front of the detonator effectively completely covering the detonator.

The particular embodiment of the barrier disclosed in this application provides a complete protection for the detonator decelerating the incoming material thereby preventing a direct impact upon the detonator.

It is therefore an object of the present invention to provide a baffle that effectively covers the surface of the detonator while the detonator retains its sensitivity.

It is a further object to provide a method to prevent direct impact upon the detonator until the shell has reached its target.

Another object is to provide greater strength to the protective shield since the cross-bars are subjected to bending forces and subsequent failure.

There are other objects of the present invention which will become apparent from the following description, taken in conjunction with the accompanying drawings.

DETAILED DESCRIPTION OF THE PREFERRED EMBODIMENT

Figure 2:
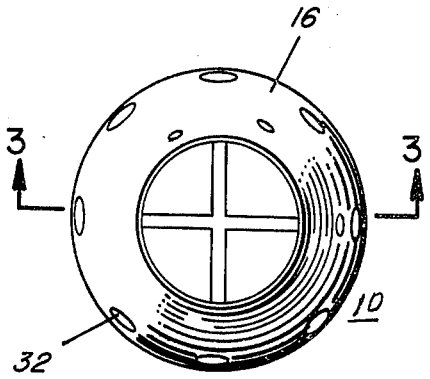
FIG. 2 is a top view of the fuze head.
Figure 3:
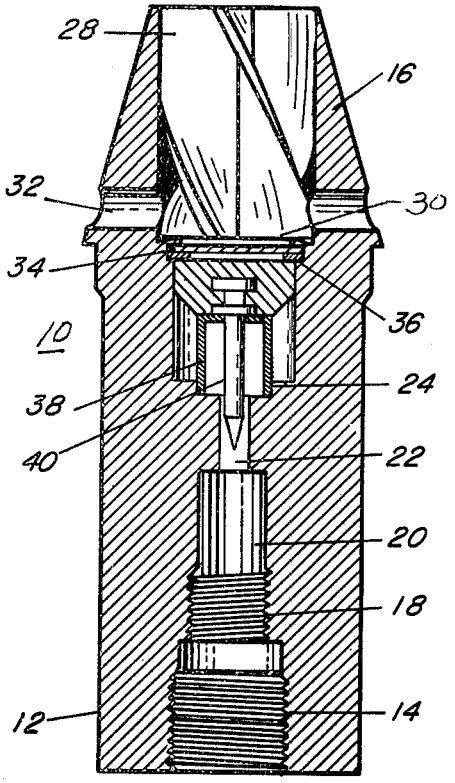
FIG. 3 is a longitudinal section view of the fuze head with the helical baffle in place taken on line 3—3 of FIG. 2.
Figure 4:
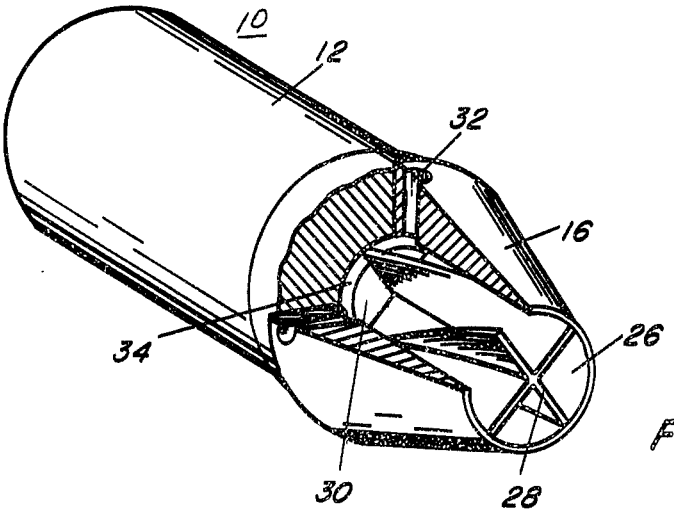
FIG. 4 is an isometric view partly in section showing further details of construction.

Referring to FIGS. 2, 3 and 4, fuze head 10 is formed of a hollow cylindrical base portion 12 capped by a frusto-conically shaped nose end 16. The base portion 12 is drilled and tapped at one end 14 so that it may be secured in a fuze. The cylindrical base portion 12 and the mechanism contained therein, which are conventional although not an object of this invention, will be discussed and numerically referenced for purposes of clarity.

Figure 1:
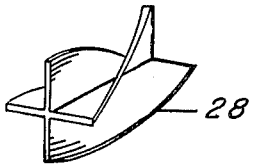
FIG. 1 is an isometric view of the helical baffle.

The fuze head 10 has an irregularly shaped passageway formed therein by a series of bores which extend from the threaded end of the fuze head 10 through the truncated conical nose end portion 16. The passageway is composed of a series of axially communicating bores to provide a continuous central passageway of varying diameter through the fuze head 10; a threaded bore 14, reduced central threaded bore 18, cylindrical bore 20, a reduced cylindrical bore 22, an enlarged cylindrical bore 24 and a further enlarged cylindrical bore 26 in the conical nose end portion 16 of the fuze head 10. The interior of the enlarged cylindrical bore 26 is open to the atmosphere at the nose end of the fuze. Within the enlarged cylindrical bore 26 is mounted the helical baffle 28 shown in FIG. 1 in isometric form. Essentially the helical baffle 28 viewed from the front is in the form of a Greek Cross and its length twisted until its far edge has moved through an arc of 90°. The length of the helical baffle should be no greater than the length of the enlarged cylindrical bore 26 in the fuze head. The baffle 28 is mounted as a press fit into cylindrical bore 26 of the fuze head having end support at 30. The baffle 28 cannot rotate but is stationary in this position. Viewed from the front end, the 90° twisting of the baffle provides a continuous protective wall from the front to the rear of the baffle aganst material entering the cylindrical frame. With this geometry no raindrop can achieve a direct impact on the closing disc but will strike the helical baffle breaking it up to the point that its speed and mass reduced sufficiently to prevent detonation. In addition, the device is provided with suitable radial apertures 32 communicating with the enlarged cylindrical bore 26 to permit the escape of water and prevent the build-up of air pockets within the cylindrical bore 26. The closing disc 34 and washer 36 are secured at the bottom portion of the cylindrical bore 26 and positioned below the aperture 32. A crush cup 38 is positioned in the bore 24 contiguous with the closing disc 34 and the washer 36. The detonator pin 40 which is appropriately housed in the casing, positioned in the cylindrical bore 24 is mounted on, and partially penetrates the crush cup 38. The detonator pin 40 is a weighted cylindrical body having a double flange formed at one end which is axially positioned on the crush cup 38.

In operation, a conventional fuze of the impact variety would detonate when hitting or striking an obstacle during its trajectory. Obstacles such as leaves, foliage or rain would generate sufficient force to rupture the closing disc 34, collapse the crush cup 38 and force the bottom portion of the detonator pin 40 through bore 22 into bore 20 thereby initiating the round. This type of conventional round cannot penetrate a canopy of foliage, pass through a rainstorm or overcome the resistance of high winds and reach its intended target without premature detonation. In addition, greater efficiency and capability are required, since fuzes are made more sensitive, and projectiles and missiles are urged to high velocities. To accomplish this goal, it was required that a higher order was needed to solve this problem.

It has now been discovered that in order to secure the most effective results from such projectiles and missiles, especially when they are used in tropics and directed toward densely wooded areas or during a rainstorm, is to effectively completely cover the detonator. Accordingly, the embodiment of the helical baffle was conceived as previously described herein which improves the penetrability of the shell and at the same time retains its sensitivity to impact with large objects. This is accomplished with a geometry characterized by the twisted cross walls where incoming material cannot achieve a direct impact on the closing disc but will hit the rotating twisted cross walls. Axially moving objects are prevented from striking the detonator while small objects such as droplets of water are permitted to pass through the barrier in directions inclined to the longitudinal axis. In addition, the material entering the cylindrical bore decelerates when it strikes against the walls of the helical baffle. In many cases this material breaks up into small fragments which reduces their mass and their subsequent impact force on the detonator. The helical baffle and the radial vent holes considered together act essentially as a projectile-borne one-way valve with a selective or differentiating response to water, air and other solid materials. Using this method it is possible to provide a greater number of shells to reach the target without exploding during flight.

I wish it to be understood that I do not desire to be limited to the exact method and detail of construction described for obvious modifications will occur to persons skilled in the art.

What is claimed is:

1. An improved impact sensitive fuze for explosive missiles comprising:

a truncated conically shaped body having a longitudinal axis and an axial bore;

said body having a plurality of apertures in its base extending transversely of said axial bore and communicating with said bore;

means for detonating said missile mounted in said bore; and barrier means, mounted in said bore intermediate the front end of said bore and said detonating means, adapted to provide an effective cover for said detonating means, thereby preventing axially moving objects from striking said detonating means, while permitting small objects, such as droplets of water, to pass through said barrier means in directions inclined to the longitudinal axis, wherein said barier means is in the form of a twisted cruciform having a twist angle of at least 90°.

* * * * *